US012521617B2

(12) United States Patent
Sorin et al.

(10) Patent No.: US 12,521,617 B2
(45) Date of Patent: Jan. 13, 2026

(54) LIGHTING SYSTEM FOR GAMIFICATION AND IMPROVEMENT OF AESTHETICS OF EXERCISE EQUIPMENT

(71) Applicants: Richard Sorin, Lexington, SC (US); Albert Sorin, Lexington, SC (US)

(72) Inventors: Richard Sorin, Lexington, SC (US); Albert Sorin, Lexington, SC (US)

( * ) Notice: Subject to any disclaimer, the term of this patent is extended or adjusted under 35 U.S.C. 154(b) by 0 days.

(21) Appl. No.: 17/724,218

(22) Filed: Apr. 19, 2022

(65) Prior Publication Data

US 2022/0331683 A1 Oct. 20, 2022

Related U.S. Application Data

(60) Provisional application No. 63/176,466, filed on Apr. 19, 2021.

(51) Int. Cl.
*A63B 71/06* (2006.01)
*A63B 24/00* (2006.01)

(52) U.S. Cl.
CPC ..... *A63B 71/0622* (2013.01); *A63B 24/0062* (2013.01)

(58) Field of Classification Search
CPC ..... A63B 71/0622; A63B 24/0062; A63B 21/078; A63B 17/00; A63B 2024/0096; A63B 2071/0625; A63B 2220/16; A63B 2220/20; A63B 2220/30; A63B 2220/40; A63B 2220/51; A63B 2225/50; A63B 2225/74
See application file for complete search history.

(56) References Cited

U.S. PATENT DOCUMENTS

| | | | | |
|---|---|---|---|---|
| 7,455,621 | B1 * | 11/2008 | Anthony | A63B 24/0062 482/3 |
| 7,666,118 | B1 * | 2/2010 | Anthony | A63B 21/0724 482/8 |
| 2021/0069572 | A1 * | 3/2021 | Lagree | A63B 71/0622 |
| 2022/0062738 | A1 * | 3/2022 | Neuhaus | A63B 71/0686 |

OTHER PUBLICATIONS

"LED Light Squat rack," published Apr. 9, 2021, by angeloj901 on Reddit: https://www.reddit.com/r/homegym/comments/mn7f9k/led_light_squat_rack/?rdt=52309 (Year: 2021).*

* cited by examiner

*Primary Examiner* — Andrew S Lo
(74) *Attorney, Agent, or Firm* — Todd A. Serbin; Maynard Nexsen PC

(57) ABSTRACT

A system for gamification and enhancement of aesthetics of exercise equipment, comprising: a control box; a weight rack; and, at least one light attached in or on the weight rack and in operative communication with the control box.

17 Claims, 7 Drawing Sheets

LIGHTING SYSTEM FOR GAMIFICATION AND IMPROVEMENT OF AESTHETICS OF EXERCISE EQUIPMENT

RELATED APPLICATION

This application claims the benefit of priority under 35 U.S.C. § 119(e) of U.S. Provisional Patent Application No. 63/176,466 filed Apr. 19, 2021, the contents of which are incorporated herein by reference in their entireties.

FIELD AND BACKGROUND OF THE INVENTION

The present invention, in some embodiments thereof, relates to exercise equipment and, more particularly, but not exclusively, to a system for enhancing exercise.

SUMMARY OF THE INVENTION

According to an aspect of some embodiments of the present invention there is provided a system for gamification and enhancement of aesthetics of exercise equipment, comprising: a control box; a weight rack; and, at least one light attached in or on the weight rack and in operative communication with the control box.

In an embodiment of the invention, the system further comprises at least one attachment or accessory.

In an embodiment of the invention, the system further comprises at least one sensor in operative communication with the control box.

According to an aspect of some embodiments of the present invention there is further provided, a kit for retrofitting exercise equipment, comprising: a control box; and, at least one light attached in or on the exercise equipment and in operative communication with the control box.

In an embodiment of the invention, the exercise equipment is a weight rack.

In an embodiment of the invention, the kit further comprises at least one sensor in operative communication with the control box.

According to an aspect of some embodiments of the present invention there is further provided a method of using a system for gamification and enhancement of aesthetics of exercise equipment, comprising: associating at least one sensor with a measurable indicator of exercise performance; commencing exercise by a user; sensing data corresponding to the measurable indicator of exercise performance using the at least one sensor; transmitting the sensed data to a control box for processing; processing the sensed data; and, using lighting to provide at least one of gamification, biofeedback, safety, and motivation, based on the processing.

In an embodiment of the invention, the lighting is adjusted in at least one of color, intensity, and pattern.

According to an aspect of some embodiments of the present invention there is further provided, a method of using a system for gamification and enhancement of aesthetics of exercise equipment, comprising: activating lighting located in and/or on the exercise equipment; optionally adjusting the lighting; optionally controlling individual lights and/or strips of the lighting; optionally deactivating the lighting.

In an embodiment of the invention, adjusting comprises adjusting at least one of color, intensity and pattern.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

Implementation of the method and/or system of embodiments of the invention can involve performing or completing selected tasks manually, automatically, or a combination thereof. Moreover, according to actual instrumentation and equipment of embodiments of the method and/or system of the invention, several selected tasks could be implemented by hardware, by software or by firmware or by a combination thereof using an operating system.

For example, hardware for performing selected tasks according to embodiments of the invention could be implemented as a chip or a circuit. As software, selected tasks according to embodiments of the invention could be implemented as a plurality of software instructions being executed by a computer using any suitable operating system. In an exemplary embodiment of the invention, one or more tasks according to exemplary embodiments of method and/or system as described herein are performed by a data processor, such as a computing platform for executing a plurality of instructions. Optionally, the data processor includes a volatile memory for storing instructions and/or data and/or a non-volatile storage, for example, a magnetic hard-disk and/or removable media, for storing instructions and/or data. Optionally, a network connection is provided as well. A display and/or a user input device such as a keyboard or mouse are optionally provided as well.

BRIEF DESCRIPTION OF THE SEVERAL VIEWS OF THE DRAWING(S)

Some embodiments of the invention are herein described, by way of example only, with reference to the accompanying drawings and images (collectively referred to herein as "drawings"). With specific reference now to the drawings in detail, it is stressed that the particulars shown are by way of example, are not necessarily to scale and are for purposes of illustrative discussion of embodiments of the invention. In this regard, the description taken with the drawings makes apparent to those skilled in the art how embodiments of the invention may be practiced.

Figure 5B:
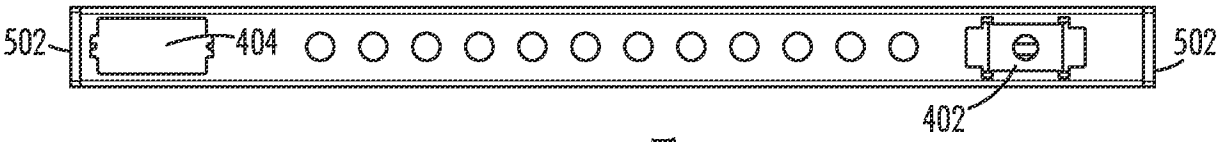
Figure 5A:
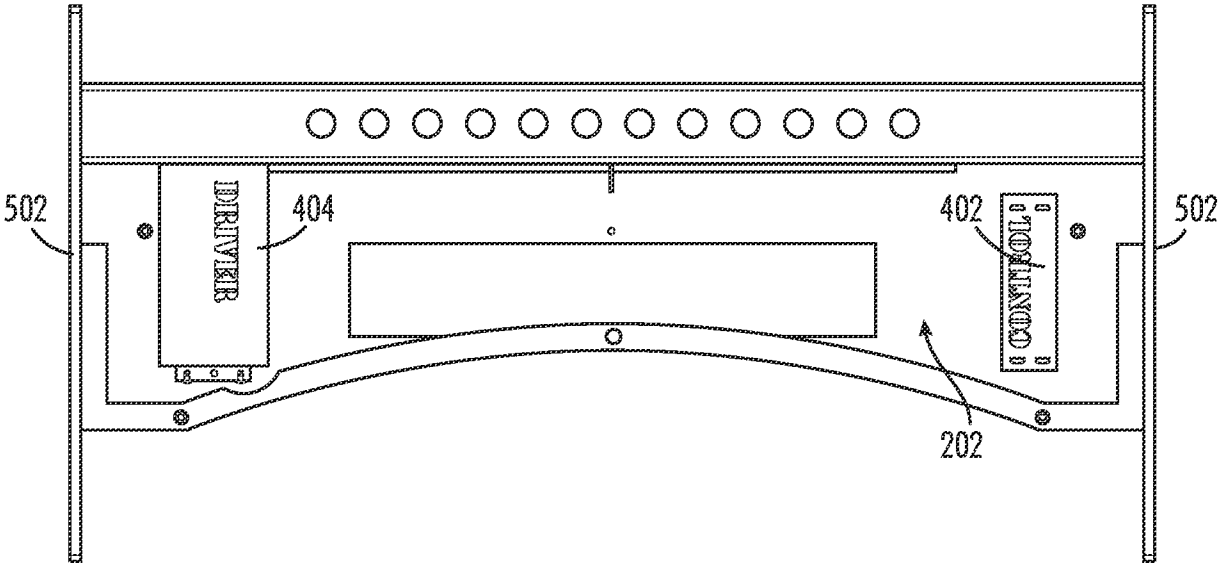
Figure 5C:
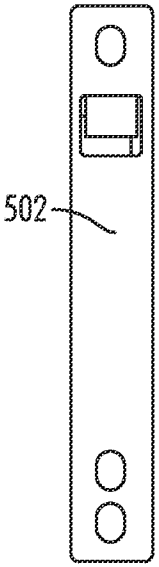
Figure 6:
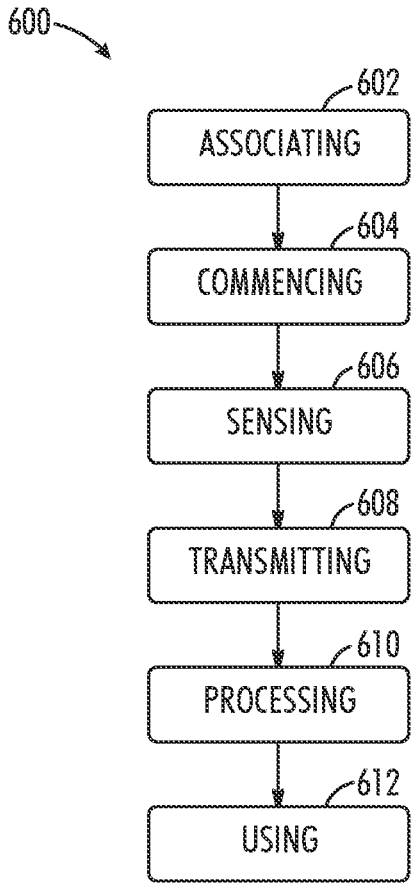
Figure 7:
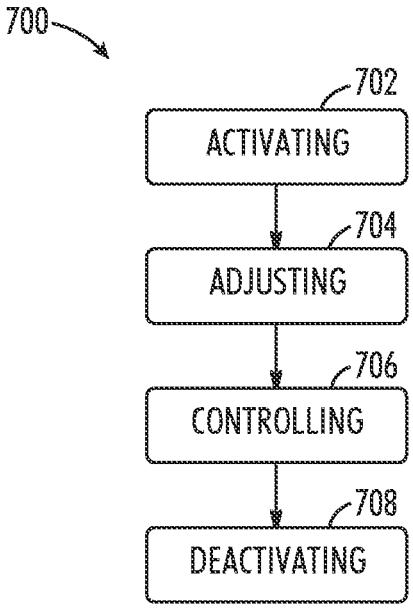

FIGS. 5A, 5B, and 5C are a front view of an open control box, a bottom view and a side view of the control box, respectively, in accordance with an exemplary embodiment of the invention;

FIG. 6 is a flowchart of using a system using lighting for gamification of exercise equipment, in accordance with an exemplary embodiment of the invention; and, FIG. 7 is a flowchart of a method of using a system using lighting for improvement of aesthetics of exercise equipment, in accordance with an exemplary embodiment of the invention.

DESCRIPTION OF SPECIFIC EMBODIMENTS OF THE INVENTION

The present invention, in some embodiments thereof, relates to exercise equipment and, more particularly, but not exclusively, to a system for enhancing exercise.

Figure 1:
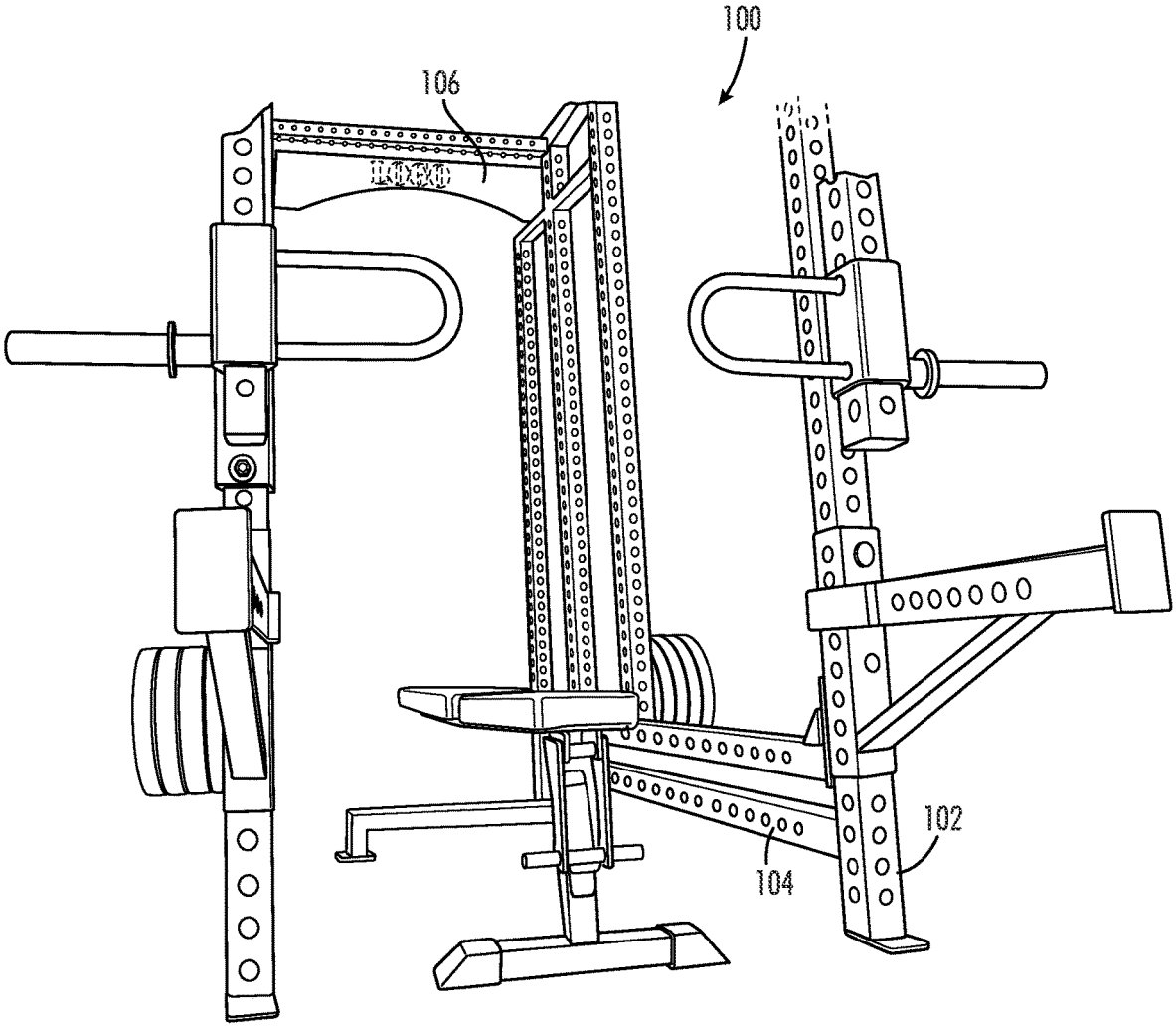
FIG.1 PRIOR ART
FIG. 1 is a perspective view of a prior art weight rack.

For purposes of better understanding some embodiments of the present invention reference is first made to the construction and operation of a weight rack. FIG. 1 is a perspective view of a prior art weight rack 100. It should be understood that, generally speaking, weight racks are multi-functional, multi-purpose structures which are adaptable to meet the needs/desires of a user. Often, the weight rack 100 is comprised of tubes, usually square-shaped in cross-section, and exhibit 3"×3" or 4"×4" dimensions. It should be understood, however, that the tubes could exhibit just about any shape and/or dimensions as long as they are safely and stably capable of supporting the weights and weightlifting equipment that will be used during exercise. The tubes used typically include upright components 102 as well as cross-linking components 104 in order to construct the rack structure. Optionally, the upright and cross-lining components are identical in form, for example being 3"×3" square tubing. An exemplary weight rack 100 could be any one of the Base Camp™, XL™ Series, Apex™, or Dark Horse™ racks available from Sorinex Exercise Equipment, Inc. at www.sorinex.com/pages/custom-racks.

Often used with a weight rack 100 are additional equipment items, examples of which include benches, weight bars, rollers, safety bars, weight bar cradles (such as J-hooks), bumpers, and attachments such as a Jammer Arm™, a Landmine™, and a JxSquat®.

In many conventional racks, there is often included a decorative add-on 106 which includes colors, lettering, and/or designs which enhance the attractiveness of the weight rack 100. As shown in FIG. 1, this add-on is in the form of an arch, although it could exhibit any physical form, such as square or rectangular, ovoid, or multi-sided. Additionally, the add-on 106 may or may not fully traverse the space between the upright components 102.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 2:
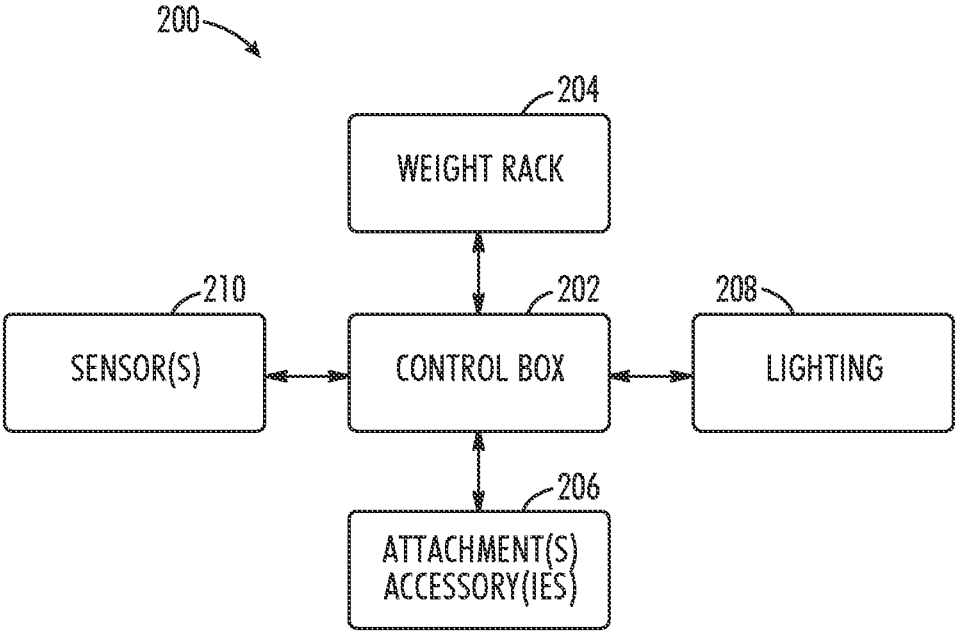
FIG. 2 is a schematic block diagram showing a system using lighting for gamification and improvement of aesthetics of exercise equipment, in accordance with an exemplary embodiment of the invention.

Referring now to the drawings, FIG. 2 illustrates a schematic block diagram showing a system 200 using lighting for gamification and improvement of aesthetics of exercise equipment, in accordance with an exemplary embodiment of the invention. In an embodiment of the invention, the system 200 includes a control box 202 which is either in direct or indirect operational communication and/or contact with a weight rack 204, optionally at least one exercise accessory or additional piece of exercise equipment, either, or both, 206, at least one lighting component 208 and/or, optionally, at least one sensor 210.

In an embodiment of the invention, the control box 202 is configured to exhibit substantially the same shape and/or size as the add-on 106 which is employed with currently available weight racks. That is, it is intended that the control box 202 of the present invention, the system 200, can be utilized in past, present and future weight racks without any modification of the conventional design of the weight rack. It is therefore further conceived that the system 200, or some components of the system 200, can be offered as a kit for retrofitting weight racks, such as weight rack 100, to update the weight rack 100 to include the system 200, including the lighting, other components and techniques described herein for gamification and/or enhancing the aesthetic appearance of the weight rack, and wherein the control box 202 of the system 200 merely replaces the add-on 106. In some embodiments of the invention, the control box 202 is installed on the weight rack 204 in a different location than the standard location for the add-on 106, for example by being attached to an upright component or a cross-linking component. Alternatively, additionally and/or optionally, the control box is not installed on the weight rack at all, for example, the control box 202 is located remotely from the weight rack 204.

In an embodiment of the invention, control box 202 includes hardware for operation and/or control of the system 200, for example at least one processor, data storage, components for power and/or communications and/or data transmission, and the like. Optionally, controls are located on the control box 202 and/or are in operable communication with the control box 202 for enabling convenient user control of at least a portion of the operation of the system 200. For example, the controls are usable to turn on/off the system 200 itself, or features of the system, and/or change the colors and/or the pattern and/or intensity of the lighting 208. In an embodiment of the invention, a remote control (not shown) is provided to the system 200 in addition to and/or in the alternative to the controls described above.

System 200 optionally controls more than one weight rack/accessory/lighting package, such that multiple users working out in multiple stations can all be controlled by a single control box 202 or system 200. In some embodiments, each rack in the grouping is individually controllable by the control box 202 and/or system 200 and/or controls (optionally, remote).

In an embodiment of the invention, the control box 202 is plugged into an outlet or is otherwise hardwired to an AC power source. Additionally, alternatively and/or optionally, the control box 202 is powered by a battery. Optionally, the battery is a click-in power-pack type of battery, found commonly with power tools.

In an embodiment of the invention, the various components of the system 200 and other related components are placed in operative communication using any conventional hardware and/or methodology known in the art, for example, using wired and/or wireless connections to transmit signals, data, current, and the like.

As described herein, the control box 202 operates lighting 208 of the system 200 to enhance the aesthetic of the weight rack 204, in an embodiment of the invention. In some embodiments of the invention, the lighting 208 is as simple as a light strand, like Christmas lights. The lighting 208 is LED lighting, in some embodiments. The LED lighting is optionally 12V or 24V, as examples. The LED lighting is in the form of strips, in an embodiment of the invention. Examples of LED lighting and related components include: RGB Led Light Tape (LLI-LCC4.4 W-65-RGB-24V), Universal RF Receiver (LLI-C-RCV-UR-RF-4CH), LED Hand Held Remote (LLI-C-CTRL-RF-RGBW-HH-BL), LED DC Driver (LLI-PS-NDE-200 W-24V) and LLI Thin Extrusion (LLI-THN), available from LLI Architectural Lighting.

In some embodiments of the invention, specific lighting 208 solutions (e.g. LED strips or light strands) are modular and/or interchangeable with other lighting solutions of a different and/or of the same type. In some embodiments of the invention, the lighting 208 is reversibly secured to the weight rack 204, for example having magnets attached to the strip or strand for attachment to ferrous weight rack components. Optionally, some form of adhesive, roping, zip ties or similar attachment mechanism is used to removably secure the lighting 208 to the weight rack 204 (or other equipment, as described below with respect to accessories/attachments 206). In some embodiments of the invention, the lighting 208, such as an LED strip, is placed internally in the weight rack components (e.g. the upright components and/or the cross-link components), which are typically hollow and which typically have holes cut into them allowing any internal lighting to radiate outwardly of the weight rack 204. The lighting 208 optionally displays at least one color, for example a color which matches the decorative features of the control box 202 which is now being used in lieu of the prior art add-on 106. In some embodiments of the invention, the lighting 208 is variable in color and/or intensity and/or pattern. Where in the past, the add-on 106 would, for example, display at least one team color, now the lighting 208 could also display a team color of that team. Optionally, the control box 202 is provided with at least one light-transparent/translucent feature wherein the lighting 208 shines through the control box 202 as a decoration. It should also be understood that each light or LED and/or each segment, strip or strand of lighting 208 can be individually controlled to enhance the aesthetic and/or gamification effect of the system 200, in an embodiment of the invention.

The system 200 also optionally includes attachments and/or accessories 206, such as those described above, like benches, weight bars, bumpers/weights, rollers, safety bars, weight bar cradles (such as J-hooks), bumpers, a Jammer Arm™, a Landmine™, and a JxSquat®. It should be understood that some or all of these can be integrated with the system 200 to provide lighting 208 for enhancing exercise. For example, for accessories/attachments 206 which are at least partially constructed from the same or similar tubing as the weight racks, at least some of the lighting 208 can be run through the internal cavity just like the weight racks. In some embodiments of the invention, the lighting 208 is optionally removably attached somewhere on the outside of the accessory/attachment 206.

In some embodiments of the invention, the system 200 includes at least one sensor 210. The at least one sensor 210 is a sensor which detects, for example, position, orientation, weight, distance, speed, acceleration, patterns, grip strength, biometric user data and/or any other measurable facet of and/or related to exercise. For example, at least one sensor 210 is placed on the weight rack 204 and/or on at least one attachment/accessory 206 and/or the user for measuring some parameter of user performance and/or exercise related information and wherein sensed data is combined with the lighting 208 of the system to provide gamification to exercise, such as shown and described in more detail in FIG. 6, which is a flowchart 600 of using the system 200 using lighting for gamification of exercise equipment, in accordance with an exemplary embodiment of the invention. For example, the sensor data from the at least one sensor 210 is used by the control box 202, or some other data processor, to determine/gauge user performance. In an embodiment of the invention, at least one sensor 210 is associated (602) with a quantifiable/measurable indicator of exercise performance. As the user commences (604) exercise, the system 200 senses (606) data corresponding to at least one characteristic of the user's exercise, and transmits (608) that sensed data to the control box 202, or some other processing unit, for processing (610) so the system 200 can determine what effect on the lighting 208, and optionally other stimuli, the sensed performance data should have. If any changes in lighting 208 or system 200 operation are called-for based on the processing (610), the system 200 then effectuates gamification (612) by altering the lighting 208. Different colors of lighting and/or different patterns of lighting and/or different intensities of lighting are can be projected by the system 200, through the lighting 208 (and optionally other experience enhancements (e.g. stimuli) like sounds and tactile feedback, such as vibration) to gamify the exercise experience.

It should be understood, however, that at least one sensor is not necessary for gamification of the exercise experience. For example, the lighting 208 can be used to set the mood for exercise and/or to increase user motivation and/or the lighting 208 can operate independently regardless of the presence of any sensed data.

As a specific example, if the user has a goal of performing 14 repetitions of an exercise, the colors progress from red, to yellow, to green as the user nears/attains the exercise goal wherein, as examples, sensing could be of the raising and lowering of a weight bar, or the degree and/or repetition of rotation of a component of the weight rack, such as a Jammer Arm™. As another example, upon attainment of an exercise goal or other preset condition, the lighting 208 flashes, gets brighter, and/or changes pattern.

In some embodiments of the invention, at least one sensor 210 is used by the system 200, along with the lighting 208, to provide biofeedback to the user. For example, if the user's form isn't as it should be, the lighting 208 conveys a "bad form" message, whereas when the user's form improves, the lighting 208 conveys a "good form" message, in some embodiments of the invention, by displaying red lighting for bad form and green lighting for good form.

In some embodiments of the invention, the at least one sensor 210 is used by the system 200, to provide an indication of proper/desired usage of the weight lifting equipment. For example, at least one sensor 210 being provided to a J-hook or a set of J-hooks to measure the weight placed on them, and thereby using the lighting 208 to indicate the amount of weight thereon, or a correct or incorrect amount of weight. As a specific example, where the user is supposed to be lifting 225 lbs., the lighting 208 is red until the weight measured by the at least one sensor 210 hits the preset 225 lbs. (the weight being measured as weights are being loaded onto a weight bar on the J-hooks), at which point, the lighting 208 turns green. As another specific example, at least one sensor 210 in combination with lighting 208 can be used as a safety feature, such as if a user is not supposed to be lifting over a certain amount, the lighting 208 will turn red and/or flash to indicate that too much weight has been loaded on (as measured by the at least one sensor 210 located on one or both of the J-hooks).

Additionally, alternatively and/or optionally, sound and/or tactile stimulation and/or other features (e.g. smoke, mist, foam, pyrotechnics) are used by system 200 to provide gamification to the user's exercise. As examples of sounds, providing cheering sounds and/or other human/crowd noise and/or explosions and/or music. Optionally, the sound and/ or tactile stimulation are used in synchrony with the lighting 208 and/or are at least partially controlled by the control box 202.

In some embodiments of the invention, the system 200 is used without any tie or connection to sensed data. For example, the lighting 208 of system 200 is used as decoration, to provide an aesthetically pleasing appearance to the control box 202, weight rack 204 and/or accessories 206 and/or other structures around the work out area or gym, and as described in further detail with respect to FIG. 7, a flowchart 700 of a method of using a system 200 using lighting for improvement of aesthetics of exercise equipment, in accordance with an exemplary embodiment of the invention. In an embodiment of the invention, lighting 208 which has been previously placed in and/or on the control box 202/the weight rack 204/attachments 206 is activated (702), optionally by the control box 202. The lighting 208 is optionally adjusted (704) to a desired color or colors, intensity, pattern, and the like. In some embodiments of the invention, individual lights of the lighting 208 and/or individual strips or strands of the lighting 208 are controlled (706) to effectuate the desired lighting aesthetic. In some embodiments of the invention, a remote control is used to activate (702), adjust (704) and/or control (706) the lighting 208. In an embodiment of the invention, the system 200 is turned off or deactivated (708) when the weight rack 204 and/or any of the attachments 206 are no longer being used for exercise. Optionally, the lighting 208 remains on even when the weight rack 204 and/or any of the attachments 206 are not in use.

In some embodiments of the invention, lighting provided by the system 200 as decoration and/or gamification can be offered in modes and/or preset configurations. Optionally, these are stored in a data storage, optionally located in the control box 202. Optionally, these modes and/or configurations are applied to multiple work out stations and/or weight racks.

Figure 3:
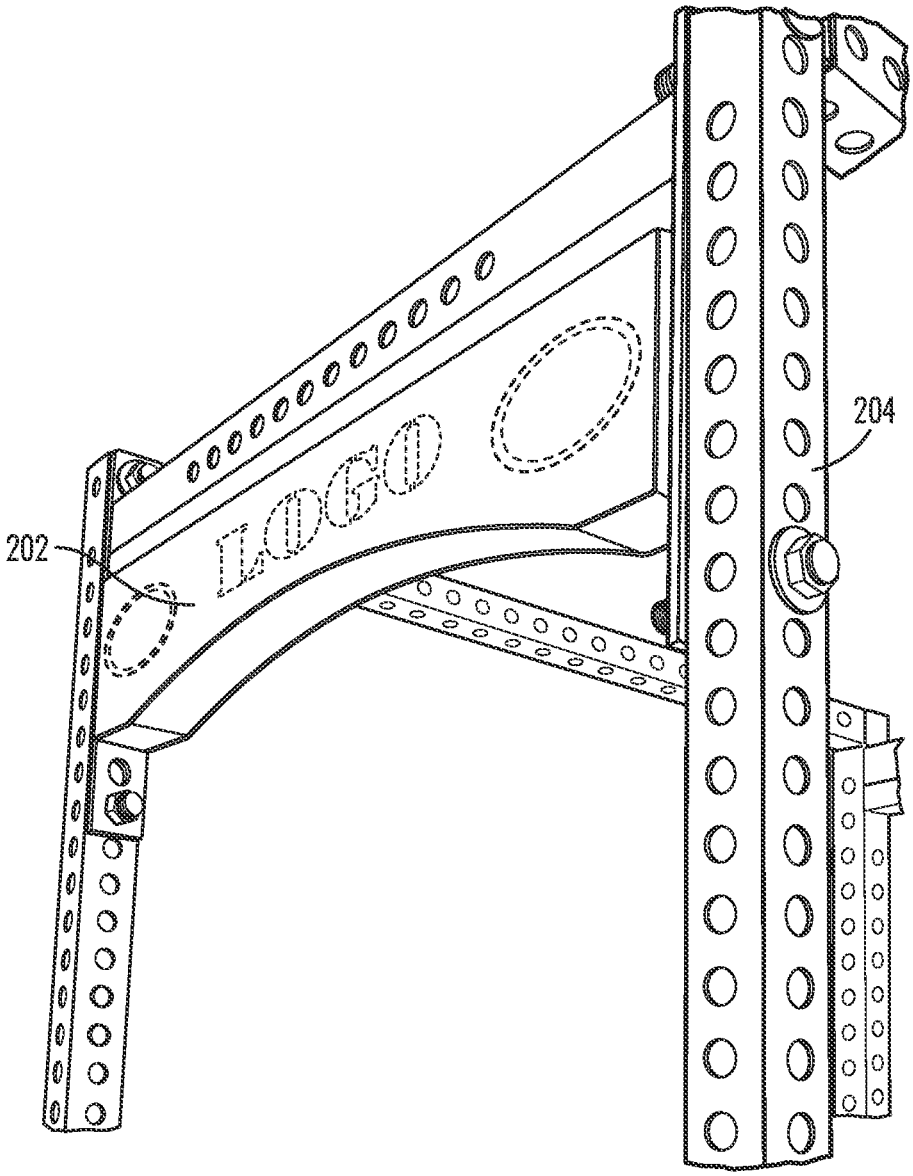
FIG. 3 is a perspective view of a control box of a system using lighting for gamification and improvement of aesthetics of exercise equipment mounted on the exercise equipment, in accordance with an exemplary embodiment of the invention.

FIG. 3 is a perspective view of the control box 202 of a system 200 using lighting for gamification and improvement of aesthetics of exercise equipment mounted on the weight rack 204 of the exercise equipment, in accordance with an exemplary embodiment of the invention. As can been seen in FIG. 3, the control box 202 essentially takes the place of add-on 106, without substantially occupying more space than the add-on 106 would have. Furthermore, the control box 202 provides similar decoration/personalization as the prior art add-on 106, while providing more functionality, in that the personalized name/logo on the control box 202 exterior is illuminable by the lighting 208.

Figure 4:
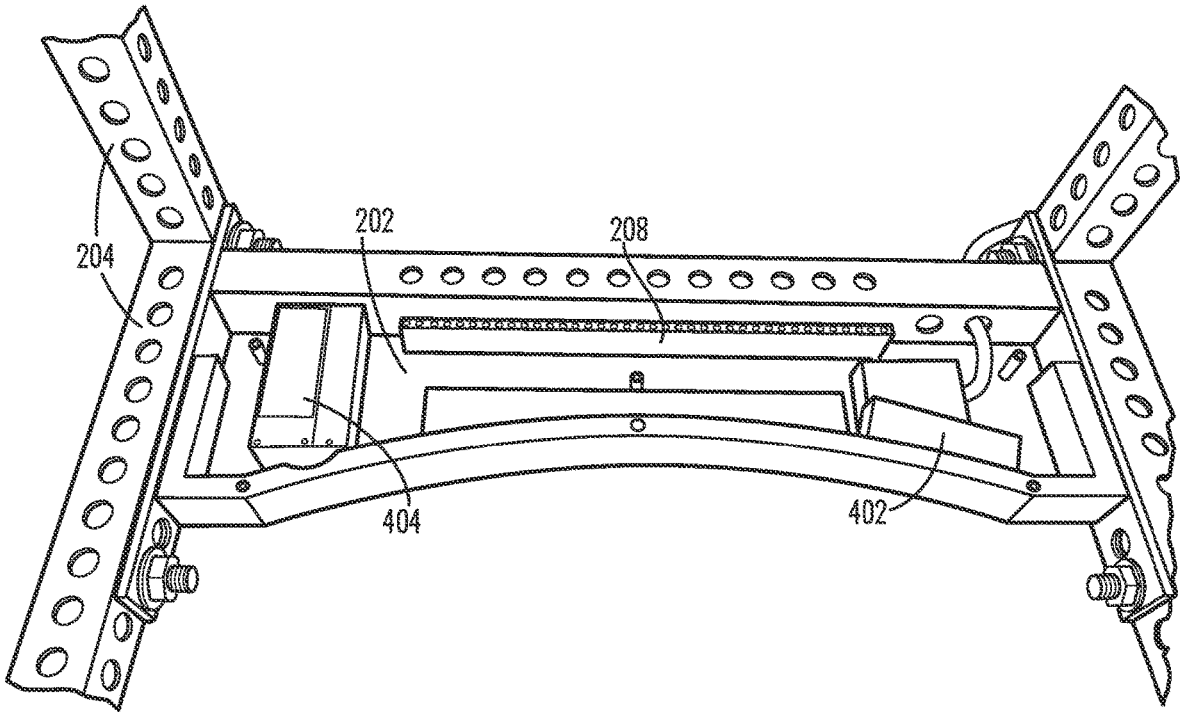
FIG. 4 is a perspective view of an open control box of a system using lighting for gamification and improvement of aesthetics of exercise equipment, in accordance with an exemplary embodiment of the invention.

FIG. 4 is a perspective view of an open control box 202 of a system 200 using lighting for gamification and improvement of aesthetics of exercise equipment, in accordance with an exemplary embodiment of the invention. Inside the control box 202 can be seen some schematic features, such as a controller/processor 402 and a lighting 208 driver 404. Also shown inside the control box 202 is a strip of lighting 208, for providing illumination to the decorative features of the exterior of the control box 202, wherein it is understood that at least some of the decorative features are light transmissive. Not all of the components which could or would be mounted in the control box 202, in some embodiments of the invention, are shown, FIG. 4 is just by way of example only.

FIGS. 5A, 5B, and 5C are a front view of an open control box 202, a bottom view and a side view of the control box 202, respectively, in accordance with an exemplary embodiment of the invention. In an embodiment of the invention, control box 202 is mounted to the upright and/or cross-link components 102, 104 of a weight rack using mounting brackets 502 which have apertures which align with the holes which are incorporated into the components 102, 104 and through which mounting screws or pins are inserted.

It is expected that during the life of a patent maturing from this application many relevant weight racks, equipment, accessories and lighting types will be developed and the scope of the terms weight rack, equipment, accessory and lighting are intended to include all such new technologies a priori.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

The term "plurality" means "two or more".

As used herein, the singular form "a", "an" and "the" include plural references unless the context clearly dictates otherwise. For example, the term "a compound" or "at least one compound" may include a plurality of compounds, including mixtures thereof.

Throughout this application, various embodiments of this invention may be presented in a range format. It should be understood that the description in range format is merely for convenience and brevity and should not be construed as an inflexible limitation on the scope of the invention. Accordingly, the description of a range should be considered to have specifically disclosed all the possible subranges as well as individual numerical values within that range. For example, description of a range such as from 1 to 6 should be considered to have specifically disclosed subranges such as from 1 to 3, from 1 to 4, from 1 to 5, from 2 to 4, from 2 to 6, from 3 to 6 etc., as well as individual numbers within that range, for example, 1, 2, 3, 4, 5, and 6. This applies regardless of the breadth of the range.

Whenever a numerical range is indicated herein, it is meant to include any cited numeral (fractional or integral) within the indicated range. The phrases "ranging/ranges between" a first indicate number and a second indicate number and "ranging/ranges from" a first indicate number "to" a second indicate number are used herein interchangeably and are meant to include the first and second indicated numbers and all the fractional and integral numerals therebetween.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable subcombination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A system for gamification and enhancement of aesthetics of exercise equipment, comprising:

a weight rack, comprising at least two upright components with lighting disposed therein;

a control box disposed in a decorative add-on space, separate from the lighting, and wherein the control box connects the at least two upright components; and, at least one light attached inside the weight rack and in operative communication with the control box.

2. The system according to claim 1, further comprising at least one attachment or accessory.

3. The system according to claim 1, further comprising at least one sensor in operative communication with the control box.

4. The system according to claim 1, further comprising at least one of a sound emitter, a tactile sensation stimulator, smoke or mist generator, foam sprayer or pyrotechnics.

5. The system according to claim 2, wherein the at least one attachment or accessory has disposed therein at least one light attached inside.

6. A kit for retrofitting exercise equipment comprising at least two upright components of a weight rack, comprising:

a control box disposed in a decorative add-on space, separate from lighting disposed within the at least two upright components, and wherein the control box connects the at least two upright components; and, at least one light of the lighting attached inside the exercise equipment and in operative communication with the control box.

7. The kit according to claim 6, further comprising at least one sensor in operative communication with the control box.

8. The kit according to claim 6, further comprising at least one of a sound emitter, a tactile sensation stimulator, smoke or mist generator, foam sprayer or pyrotechnics for attachment to the exercise equipment.

9. The system according to claim 6, further comprising at least one light for attachment inside at least one attachment or accessory.

10. A method of using a system for gamification and enhancement of aesthetics of exercise equipment comprising at least two upright components of a weight rack, comprising:

associating at least one sensor with a measurable indicator of exercise performance;

commencing exercise by a user;

sensing data corresponding to the measurable indicator of exercise performance using the at least one sensor;

transmitting the sensed data to a control box for processing the control box disposed in a decorative add-on space, separate from lighting, and wherein the control box connects the at least two upright components;

processing the sensed data; and, using the lighting disposed inside the exercise equipment to provide at least one of gamification, biofeedback, safety, and motivation, based on the processing.

11. The method according to claim 10, wherein the lighting is adjusted in at least one of color, intensity, and pattern.

12. The method according to claim 10, wherein the exercise equipment is at least one of a weight rack, attachment or accessory.

13. The method according to claim 10, further comprising using at least one of sound, tactile stimulation, smoke, mist, foam or pyrotechnics to provide gamification and enhancement of aesthetics of the exercise equipment.

14. A method of using a system for gamification and enhancement of aesthetics of exercise equipment comprising at least two upright components of a weight rack, comprising:

activating lighting located inside the exercise equipment;

optionally adjusting the lighting;

optionally controlling individual lights and/or strips of the lighting;

optionally deactivating the lighting, wherein at least one of the activating, adjusting, controlling and deactivating are controlled by a control box disposed in a decorative add-on space, separate from the lighting, and wherein the control box connect the at least two upright components.

15. The method according to claim 14, wherein adjusting comprises adjusting at least one of color, intensity and pattern.

16. The method according to claim 14, wherein the exercise equipment comprising at least one of a attachment or accessory.

17. The method according to claim 14, further comprising using at least one of sound, tactile stimulation, smoke, mist, foam or pyrotechnics to provide gamification and enhancement of aesthetics of the exercise equipment.

* * * * *